US007028505B2

(12) United States Patent
Cardinale

(10) Patent No.: US 7,028,505 B2
(45) Date of Patent: Apr. 18, 2006

(54) COOLING DEVICE FOR BEER PITCHER

(76) Inventor: Anthony J. Cardinale, 9 Dervend Cir., Matamoros, PA (US) 18336

( * ) Notice: Subject to any disclaimer, the term of this patent is extended or adjusted under 35 U.S.C. 154(b) by 0 days.

(21) Appl. No.: 10/887,676

(22) Filed: Jul. 9, 2004

(65) Prior Publication Data

US 2006/0005569 A1 Jan. 12, 2006

(51) Int. Cl.
*F25D 3/08* (2006.01)

(52) U.S. Cl. ..... 62/372; 62/457.3

(58) Field of Classification Search .... 62/457.1–457.9, 62/293, 371–372

See application file for complete search history.

(56) References Cited

U.S. PATENT DOCUMENTS

| | | | | | |
|---|---|---|---|---|---|
| 2,468,661 | A * | 4/1949 | Gladstone | 222/130 |
| 4,843,836 | A | 7/1989 | Childers | 62/293 |
| 5,235,823 | A | 8/1993 | Coker | 62/530 |
| 5,299,433 | A | 4/1994 | Harms et al. | 62/457.2 |
| 5,472,274 | A * | 12/1995 | Baillie | 366/129 |
| 5,799,501 | A * | 9/1998 | Leonard et al. | 62/457.3 |
| 5,984,951 | A * | 11/1999 | Weiss et al. | 607/109 |
| 6,089,038 | A * | 7/2000 | Tattam | 62/457.2 |
| 6,295,831 | B1 * | 10/2001 | Watson | 62/457.3 |
| 6,324,864 | B1 * | 12/2001 | Stewart et al. | 62/457.3 |
| 6,745,594 | B1 * | 6/2004 | Kreutzman et al. | 62/457.2 |
| 2004/0065109 | A1 | 4/2004 | Metcalf | 62/457.3 |

* cited by examiner

*Primary Examiner*—William E. Tapolcai
(74) *Attorney, Agent, or Firm*—Bernhard P. Molldrem, Jr.

(57) ABSTRACT

A beverage chiller device for a serving pitcher has a lower stainless steel cylinder and an upper food-grade plastic sleeve. The upper end of the device is open to receive ice. A flexible strap attached onto the upper sleeve has a free end that can pass through a handle of the serving pitcher, with the lower end of the device immersed in the beverage and situated at a base of said pitcher. The flexible strap forms a closed loop that secures the chiller device to the serving pitcher. The flexible strap also permits the chiller device to pivot when the pitcher is tipped for pouring, so that the device remains more or less erect, and so meltwater does not pour out of the chiller device when the customer is pouring a drink from the pitcher. The flexible strap allows the stainless steel cylinder to drop down to the base of the pitcher, so the cylinder remains immersed in the beverage at the bottom of the pitcher.

11 Claims, 2 Drawing Sheets

COOLING DEVICE FOR BEER PITCHER

BACKGROUND OF THE INVENTION

This invention relates generally to chillers for maintaining cold beverages at a cool temperature using ice, and is more particularly concerned with an improved chiller device that isolates the ice from the beverage so that the beverage is not diluted by meltwater.

Many types of beverage are served in a pitcher, and are distributed to individuals by pouring from the pitcher into a glass. For some beverages, such as soft drinks, iced tea, or lemonade, ice is placed directly into the beverage itself in the pitcher to keep it cool until it is poured out of the pitcher and consumed. However, other beverages, such as beer, ale, or various wine based drinks, have complex flavors that would be affected by direct contact with the ice, and dilution of the beverage with meltwater would be undesirable.

A pitcher with a separate compartment for ice has been proposed, e.g., in U.S. Pat. No. 6,295,831 to Wilson. Ice is placed into a cooling chamber that is molded into the pitcher. The pitcher itself is molded of a plastic material, which is not a good conductor of heat, and so the ice compartment wall is an insulating barrier that keeps the ice from absorbing heat from the beer or ale in the main beverage compartment. The heat flow between the beverage and the ice is especially low when most of the beer or ale has been consumed and only a small amount of the beer or ale remains in the pitcher in contact with the compartment wall of the cooling chamber. Also, the pitcher's beverage capacity is more limited than it would need to be if the pitcher is later used for a soft beverage such as iced tea, lemonade, or drinking water where the ice is mixed directly in with the beverage.

A self-cooling beverage container, with a base that contains a freezable liquid or gel is proposed in Publication U.S. 2004/0065109. There, the pitcher's base is separated from the pitcher for freezing, and then is screwed into the base of the pitcher for use.

A cylindrical ice-containing chiller device for use in a pitcher has been proposed in U.S. Pat. No. 4,843,836. In that device there is a lower aluminum cylinder that contains the ice and an upper plastic top that clips onto the pitcher. The aluminum cylinder is immersed into the beverage in the container, and allows the ice to keep the beverage cool while preventing the meltwater from the ice from diluting the beverage. The top portion has a clip that fastens onto the pitcher handle when the chiller device is inserted into beverage in the pitcher. As the ice melts, the meltwater stays inside the aluminum cylinder. This device has the advantage that it can be removed from the pitcher so the pitcher can be washed and reused either with or without the chiller device, as desired. On the other hand, the position of the device in the pitcher is fixed because of the way the device clips onto the pitcher handle. The device tilts when the pitcher is tilted, and the ice meltwater can pour out from the device when the pitcher is tipped for pouring.

Also, because of the chemistry of the beer or ale, and of the aluminum used in this device, the aluminum cylinder can affect the flavor of the beverage.

In addition, because the clip on this proposed chiller device simply slips onto the beer pitcher handle, customers can remove the devices from the pitcher, and in some establishments pilferage can become a problem.

Another chiller arrangement for beverage pitchers has been proposed in U.S. Pat. No. 6,324,864, and is in the form of a tubular post that contains a freezable gel. The post screws into a threaded receptacle affixed in the base of the pitcher. An advertising sign can be affixed onto the top end of this post.

OBJECTS AND SUMMARY OF THE INVENTION

Accordingly, it is an object of this invention to provide a beverage chiller device that avoids the drawbacks of the prior art.

It is another object to provide a beverage chiller device that maintains the beverage in the pitcher at a cold temperature, and is effective even when only a small portion of the beverage remains in the pitcher.

It is another object to provide a beverage chiller device that employs ice to chill or cool the beverage, without dilution from meltwater and without the device itself affecting the flavor.

It is a further object to provide a device that can be used in a tavern or other establishment, and avoids risk of pilferage or unauthorized removal of the device from the pitcher, but can be easily removed by authorized staff of the establishment for washing and reuse of the pitcher and the chiller device.

It is yet another object to provide a beer or ale chiller device in which the device remains generally erect when the pitcher is tilted or tipped for pouring.

In accordance with an aspect of the present invention, a beverage chiller device of the type that employs ice keeps a chilled beverage cold in a serving pitcher without diluting the beverage with meltwater from the ice. The chiller device has a lower stainless steel cylinder and an upper food-grade plastic sleeve. The lower cylinder is hollow and formed of a food-grade stainless steel, and has an open upper end and a closed lower end. The upper sleeve is generally cylindrical in shape and is formed of a food-grade rigid plastic resin, preferably an ultra-high molecular weight polyethylene. The sleeve has a lower end that fits over the open upper end of the lower hollow cylinder, and an upper end that is open to receive the ice. A flexible strap, preferably formed of a food-grade material, is attached onto the upper sleeve. This strap has at least one free end that can pass through a handle of the serving pitcher to attach the chiller device to the serving pitcher with the lower end of the lower cylinder immersed in the beverage and situated at a base of said pitcher. The flexible strap employs suitable means for joining the strap onto itself (or onto a portion of the sleeve) to form a closed loop that secures the chiller device to the serving pitcher. The flexible strap also permits the chiller device to pivot when the pitcher is tipped for pouring, so that the device remains more or less erect, and so meltwater does not pour out of the chiller device when the customer is pouring a drink from the pitcher. Also, the flexible nature of the strap allows the stainless steel cylinder to drop down to the base of the pitcher, so the cylinder remains immersed in the beverage at the bottom of the pitcher. When the flexible strap is attached at the rim or hung over the rim of the pitcher, the strap does not come into contact with the liquid in the pitcher.

In one preferred arrangement, a cable tie or equivalent can be used as the flexible strap. The cable tie threads through a receptacle, i.e., a tunnel, formed on the plastic upper sleeve. Then the tongue end of the cable tie threads through the handle of the pitcher and is pulled through the anchor formed on the other end of the cable tie. The anchor locks to the transverse teeth or ribs formed on the tongue portion, and this deters customer removal of the device from the pitcher. However, the serving staff can simply cut the cable tie and discard it after the empty pitcher is collected and then later install a fresh cable tie into the chiller device when it is needed for reuse. These cable ties are common and inexpensive items.

As one possible alternative, a ball chain, preferably formed of a suitable stainless steel or other suitable material, can be used as the flexible strap. In that case, a snap closure may be used of the type that requires a crimping tool for connecting and disconnecting from the chain. The tool would be maintained at the bar or serving area.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT

Figure 1:
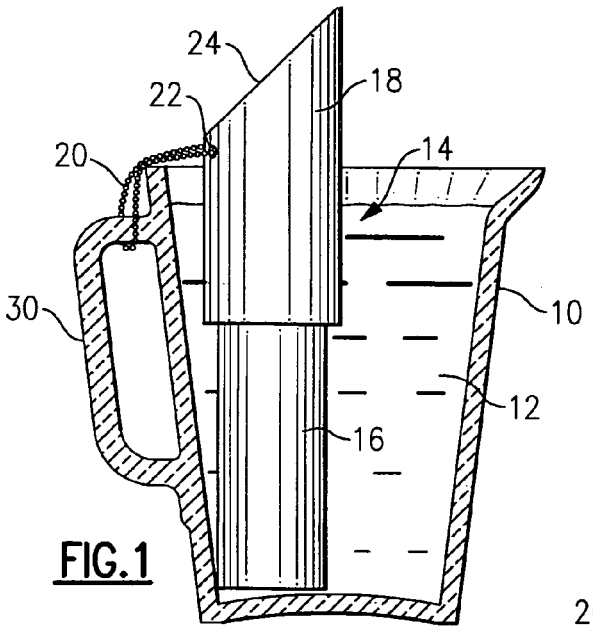
FIG. 1 is a cutaway side elevation of a pitcher and a beverage chiller device according to one preferred embodiment of the present invention.

With reference to the Drawing, and initially to FIG. 1 thereof, a drink pitcher 10 is shown containing a fill of a liquid beverage 12. A chiller device 14 according to this invention is shown to be elongated and generally cylindrical in shape, and is disposed vertically within the pitcher 10, so that the device 14 is inserted into the beverage 12. The device 14 has a lower elongated vertical cylinder 16 and an upper generally cylindrical sleeve 18 that is affixed onto the lower cylinder 16. A flexible strap 20, which will be discussed in detail later, passes through a receptacle on the sleeve 18 and loops onto the handle 30 of the pitcher.

Figure 5:
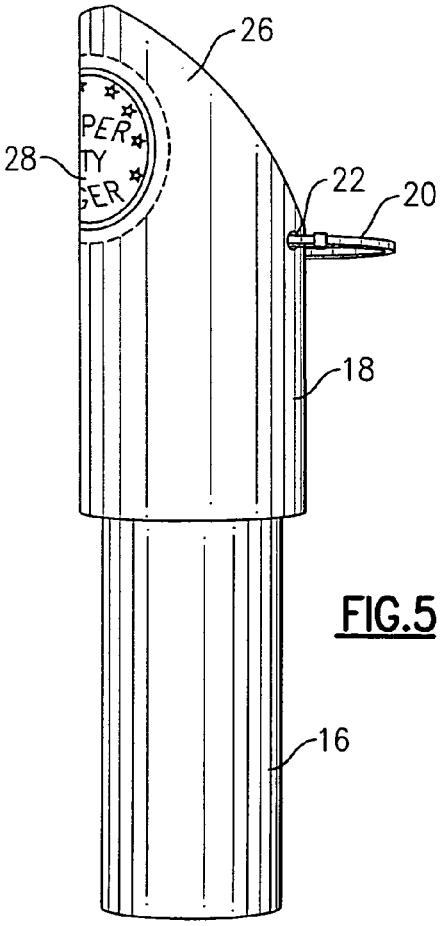
FIG. 5 is an elevation of the chiller device of this embodiment showing a label or emblem embossed or printed thereon.
Figure 2:
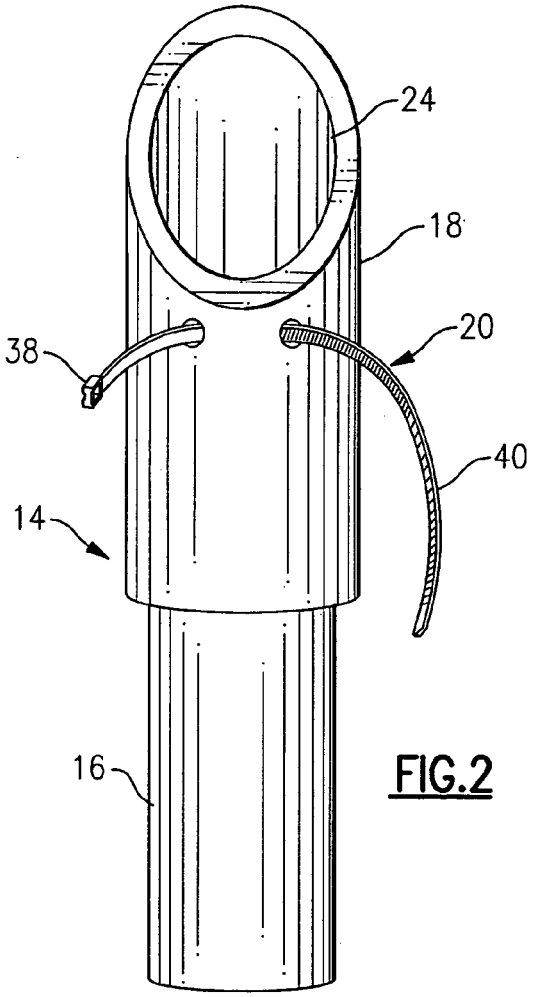
FIG. 2 is an front elevation of the chiller device of this embodiment.

As shown in more detail in FIGS. 2, 3, 4, and 5, the receptacle 22 can be in the form of a tunnel that is bored transversely through the side wall of the sleeve 18, with two openings appearing as illustrated. The sleeve 18 may have a beveled or sloping top edge 24, so that the sleeve has a high sidewall 26 on the side away from the receptacle. Here an emblem or design 28, as shown in FIG. 5, can be formed, e.g., by printing or embossing, on the high sidewall portion, and this emblem 28 may be an advertising logo, a logo of a featured beverage brand, or the name or emblem of the establishment.

Figure 3:
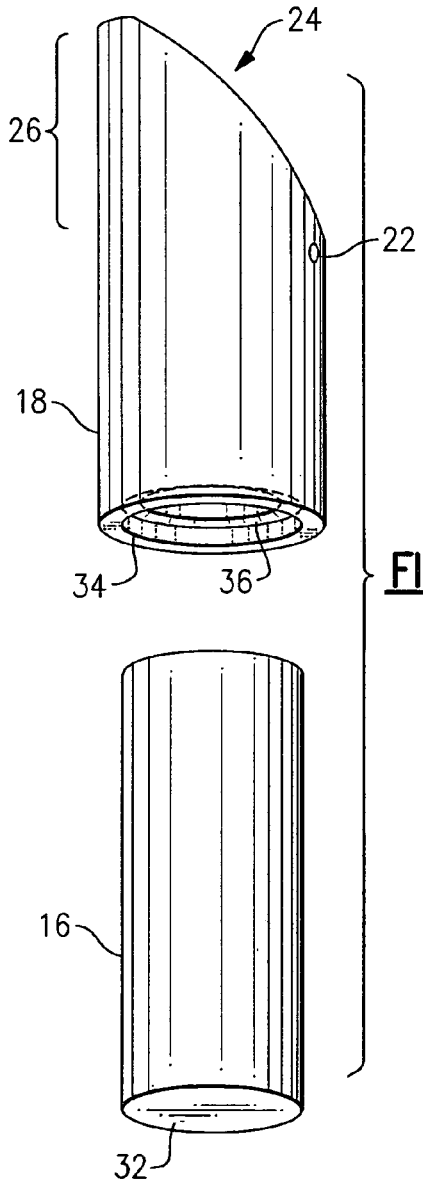
FIG. 3 is an exploded view of the chiller device according to this embodiment.

As shown in FIG. 3, the lower cylinder 16 has a closed bottom wall 32, the upper end of the cylinder being open so that it can receive ice. The sleeve 18 has an opening or socket 34 at its lower end so that it can receive the upper end of the cylinder 16 and hold it in an interference fit. There is an internal shoulder 36 just above the bottom end of the sleeve 18, and this permits the cylinder 16 and sleeve 18 to have the same inside diameter.

Returning to FIG. 2, the flexible strap 20 of this embodiment is shown to take the form of a cable tie of the type that is commonly used for strapping or bundling, with a locking anchor 38 at one free end of the tie and a tongue portion 40, i.e., a transversely ribbed or toothed strip, extending from the receptacle 22 of the device 14. The tongue portion 40 can be looped through the pitcher handle 30, and then pulled through the anchor 38, where the cable locks in place. The strap can be removed by cutting it, and can be replaced later with another similar cable tie.

Figure 4:
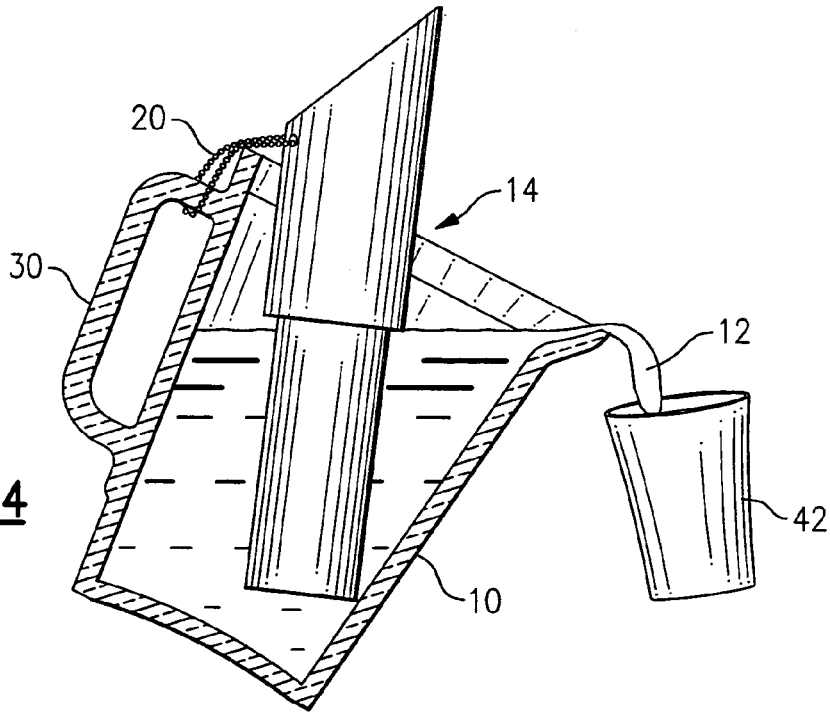
FIG. 4 is another cutaway side elevation of the pitcher and beverage chiller of this embodiment, showing pouring of the beverage from the pitcher.

Pouring of the beverage 12 from the pitcher 10 is illustrated in FIG. 4. The customer can distribute the beer, ale, or other beverage into an individual drinking glass 42 by tipping the pitcher 10 in the usual fashion. As shown, because of the flexible nature of the strap 20, the device 14 is allowed to swing about a pivot axis formed at the top rim of the pitcher above the handle, and this allows the chiller device to remain substantially vertical when the pitcher is tilted or tipped. The flexible nature of the strap 20 also lets the bottom of the device 14 extend down to the base of the pitcher, so that the cooling effect of the device is maintained even when there is only a small amount of the beverage remaining in the pitcher.

Figure 6:
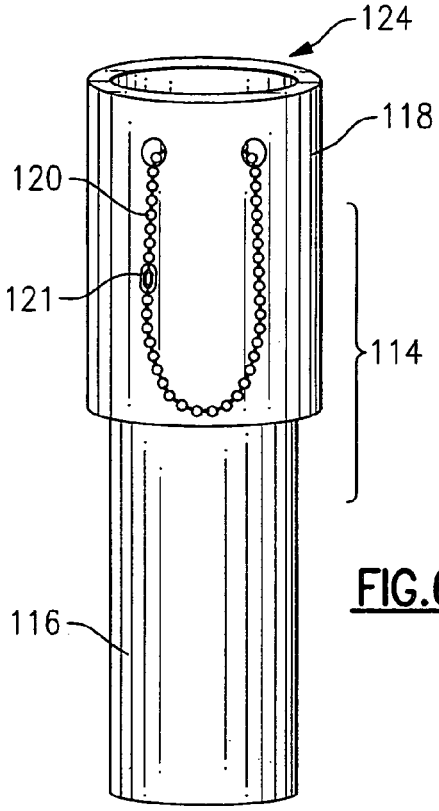
FIG. 6 is an elevation of another embodiment of the chiller device of this invention.

Another possible embodiment of this invention is illustrated in FIG. 6. Here, a chiller device 114 is generally similar to the device 14 described earlier, and has a lower stainless-steel cylinder 116 fitted into an upper plastic sleeve 118, the latter preferably formed of a food-grade UHMW polyethylene material. Here, the sleeve 118 has a generally flat top edge 124, i.e., generally perpendicular to the axis of the device. In this embodiment, the flexible strap is formed of a ball chain 120 formed of a stainless steel, with a snap closure 121. The closure may be of the type that requires a tool to close and to open, with the tool, e.g, a crimping tool, being available to the bar staff but not to customers, so that the ball chain 120 and closure 121 serve to deter pilferage.

In the preferred embodiments, the stainless steel used in the cylinder 116 is favorably a 300 series stainless steel, with a chromium content of about 17 to 20 percent. This type of stainless steel is much more resistant to corrosion damage than is aluminum, but still has an acceptable heat transfer characteristic across the wall of the cylinder 16 so as to maintain the beverage at a desirable cool temperature without affecting the taste. The stainless steel is also much more resistant than aluminum to damage from cleaning compounds when the device is washed and rinsed between uses.

The preferred food grade plastic in the sleeve 18 or 118 is Tivar UHMW polyethylene, which has good molding and extrusion characteristics, and at the same time is durable and taste free.

The embodiments described above and illustrated in the Drawing figures are meant to be illustrative of the main principles of this invention. The invention is certainly not limited only to these embodiments. Rather many modifications and variations are possible and would become evident to persons of ordinary skill, which would not depart from the scope and spirit of this invention, as defined in the appended claims.

I claim:

1. A beverage chiller device employing ice for keeping a chilled beverage cold in a serving pitcher without diluting the beverage with meltwater from the ice; the device comprising a lower hollow cylinder of a food-grade stainless steel, having an open upper end and a closed lower end;

an upper sleeve of a food-grade rigid plastic resin having a lower end fitting over the open upper end of the lower hollow cylinder, and an upper end that is open to receive the ice; and a flexible strap removably attached onto said upper sleeve, said strap having at least one free end that can pass through a handle of the serving pitcher to attach the chiller device to the serving pitcher with the lower end of the lower cylinder immersed in the beverage and situated at a base of said pitcher;

said flexible strap including means for forming the strap into a closed loop to secure the chiller device to the serving pitcher;

said flexible strap being adapted to allow the chiller device to drop down to permit the lower hollow cylinder to reach the bottom of the pitcher so that the cooling effect of the device is maintained even when there is only a small amount of the beverage remaining in the pitcher.

2. The beverage chiller device according to claim 1, wherein said upper sleeve is formed of an ultra high molecular weight polyethylene.

3. The beverage chiller device according to claim 2, wherein said upper sleeve is formed of Tivar.

4. The beverage chiller device according to claim 1, wherein said lower cylinder is formed of a food-grade stainless steel of 17 to 20 percent chromium.

5. The beverage chiller device according to claim 1, wherein the open upper end of said sleeve is beveled so that one side of the sleeve has a portion that projects up above the serving pitcher.

6. The beverage chiller device according to claim 5, wherein an emblem, logo, or advertisement is printed onto said portion of said one side of the sleeve.

7. The beverage chiller device according to claim 1, wherein said flexible strap includes a cable tie that passes through a receptacle formed in said upper sleeve, and having a locking anchor formed at one end of the cable tie and a toothed strap portion that is inserted into said locking anchor to secure the strap onto the handle of the pitcher.

8. The beverage chiller device according to claim 1, wherein said flexible strap includes a ball chain formed of a food-grade material.

9. The beverage chiller device according to claim 1, wherein said sleeve has a receptacle therein for said strap, the receptacle being in the form of a tunnel formed in the side wall of said sleeve.

10. The beverage chiller device according to claim 1, wherein said means for forming includes means for joining the strap onto itself to form the closed loop.

11. The beverage chiller device according to claim 1, wherein said flexible strap is adapted to permit the hollow cylinder of the device to swing about a pivot axis formed at the top of the serving pitcher, such that the chiller device remains substantially vertical when the pitcher is tipped for pouring.

* * * * *